United States Patent [19]

Grollimund

[11] Patent Number: 4,942,889

[45] Date of Patent: Jul. 24, 1990

[54] EXPANDED WEB OF SHEET MATERIAL AND METHOD OF MAKING SAME

[75] Inventor: Everett C. Grollimund, Midlothian, Va.

[73] Assignee: Philip Morris Incorporated, New York, N.Y.

[21] Appl. No.: 826,618

[22] Filed: Feb. 6, 1986

Related U.S. Application Data

[62] Division of Ser. No. 613,159, May 23, 1989, Pat. No. 4,585,016.

[51] Int. Cl.[5] ..... A24D 1/02

[52] U.S. Cl. ..... 131/365; 131/358; 156/270; 156/470; 428/183; 428/184; 428/186

[58] Field of Search ..... 131/365, 358; 156/270, 156/470; 428/183, 184, 186

[56] References Cited

U.S. PATENT DOCUMENTS

| | | |
|---|---|---|
| 2,539,356 | 1/1951 | Sidebotham . |
| 3,616,077 | 10/1971 | Jessee et al. . |
| 3,910,287 | 10/1975 | Walton . |
| 3,940,529 | 2/1976 | Hepford et al. . |

FOREIGN PATENT DOCUMENTS

| | | |
|---|---|---|
| 58840 | 9/1891 | Fed. Rep. of Germany . |
| 1627772 | 2/1971 | Fed. Rep. of Germany . |
| 439794 | 6/1912 | France . |
| 1286127 | 1/1962 | France . |
| 1349792 | 12/1963 | France . |
| 2020596 | 7/1970 | France . |

*Primary Examiner*—V. Millin

*Attorney, Agent, or Firm*—Thomas L. Secrest

[57] ABSTRACT

A composite expanded web for making a cigarette wrapper is provided, the web comprising a laminate of a first web of generally flat sheet material and a second web of expanded sheet material. The expanded web is formed by passing a web of sheet material through rotary shearing and forming dies to impart to the web a configuration having longitudinally disposed rows of generally sinusoidal convolutions extending above and below the original plane of the web, each row of convolutions lying 180° out of phase from its abutting rows. The composite web is formed into a wrapper for a smoking article by curling it about its longitudinal axis, securing the overlapping edges of the first web with a glue seam, and cutting it to the desired length.

19 Claims, 5 Drawing Sheets

EXPANDED WEB OF SHEET MATERIAL AND METHOD OF MAKING SAME

This is a division of Ser. No. 613,159, filed May 23, 1984, now U.S. Pat. No. 4,585,016.

FIELD OF THE INVENTION

This invention relates to an expanded web particularly adaptable for making a cigarette wrapper. This invention further relates to a composite expanded web for making a cigarette wrapper, the composite web comprising a lamination of an expanded web and a planar web. A suitable apparatus for forming the composite expanded web is disclosed and claimed in my copending U.S. application Ser. No. (PM 1176A). While such expanded and composite webs are especially suitable for the manufacture of cigarette wrappers, the invention herein disclosed and claimed is more broadly adaptable to webs for a variety of applications.

BACKGROUND OF THE INVENTION

In the mass production of cigarettes, maintenance of standard characteristics from cigarette to cigarette is important. One standard characteristic closely controlled by manufacturers is cigarette firmness, which generally is a function of tobacco rod density. Firmness affects smoking characteristics and contributes to the subjective feel of the cigarette in the smoker's hand.

The conventional cigarette wrapper is relatively flimsy paper which imparts little or no strength or rigidity to the cigarette rod, but rather serves primarily to contain the tobacco. Thus, the cigarette rod derives its strength and firmness almost entirely from the density of tobacco in the rod. Reduction of rod density usually results in a less firm cigarette.

Therefore, there exists a need for a cigarette wrapper which will provide desired firmness and strength in a cigarette rod relatively independently of tobacco rod density. Various solutions to this need have been proposed, two of which are disclosed and claimed in pending U.S. applications Ser. Nos. 592,070 and 592,063 both filed on Mar. 22, 1984 and commonly assigned herewith.

SUMMARY OF THE INVENTION

This invention provides an expanded web and a composite web suitable for use as a cigarette wrapper and a method for making the expanded and composite webs, which method can be employed at high speed and directly on line with a cigarette making machine. A planar web of formable sheet material is sheared and formed to create an expanded web having rows of generally sinusoidal convolutions extending across its width and down its longitudinal axis. The expanded web is laminated to a second web, preferably consisting of conventional cigarette paper, which forms the outer layer of a cigarette wrapper when the composite web is curled about its longitudinal axis to form a tube encircling a tobacco rod.

It is an object of this invention to provide a method of making an expanded web of sheet material It is another object of this invention to provide a method of manufacturing an expanded cigarette wrapper, which can be employed at high speed directly on line with a cigarette making machine.

It is another object of this invention to provide a composite web for use as a cigarette wrapper.

It is a further object of this invention to provide an expanded wrapper whose permeability to gas flow along its longitudinal axis may be varied to regulate smoke dilution.

These and other objects and advantages of the invention may be seen in the following description taken in conjunction with the drawings.

DETAILED DESCRIPTION OF THE PREFERRED EMBODIMENT

Figures 1, 2:
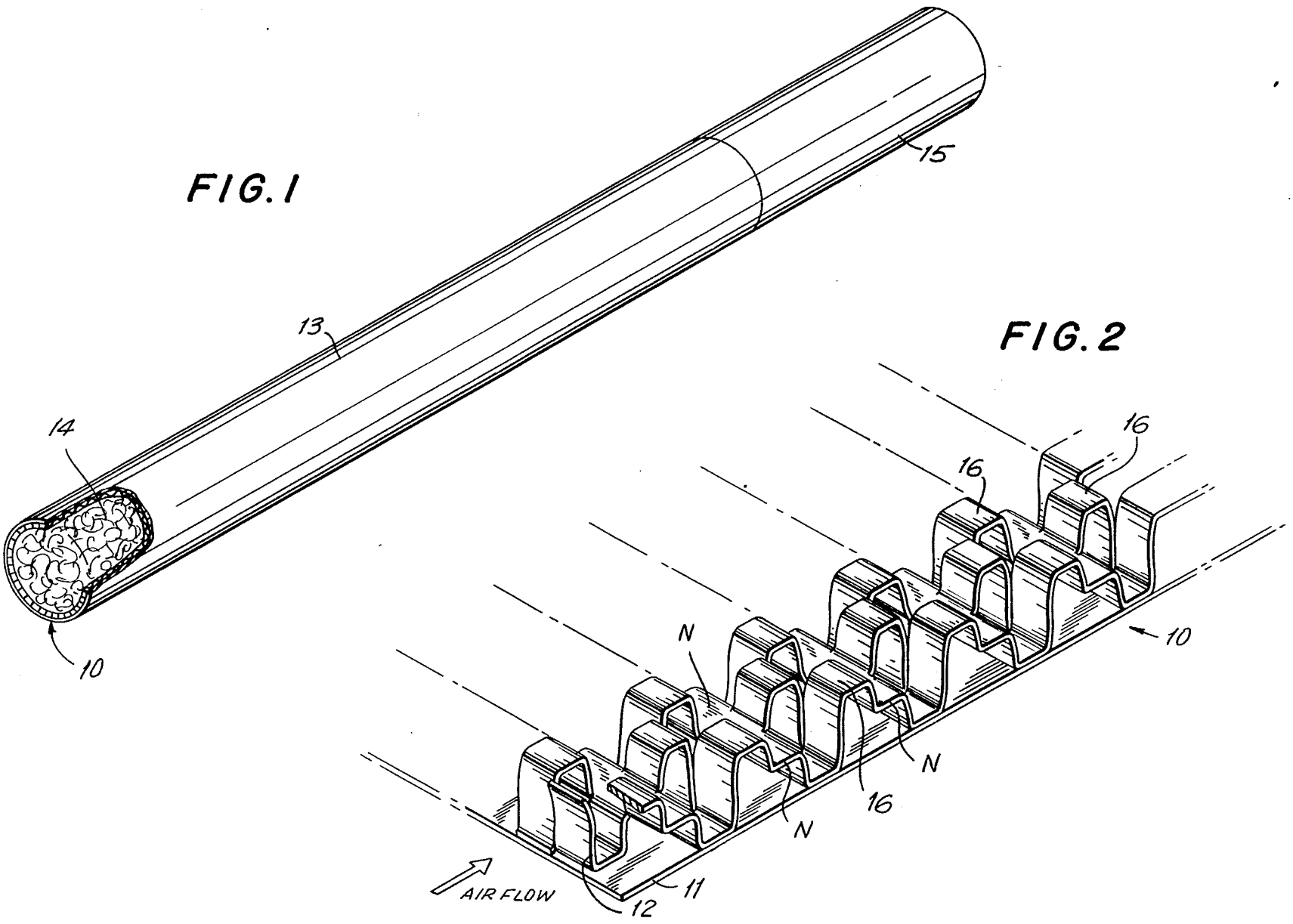
FIG. 1 is a partially cut-away perspective view of cigarette having a wrapper formed from the composite web of this invention.
FIG. 2 is a perspective view of the composite web.
Figure 3:
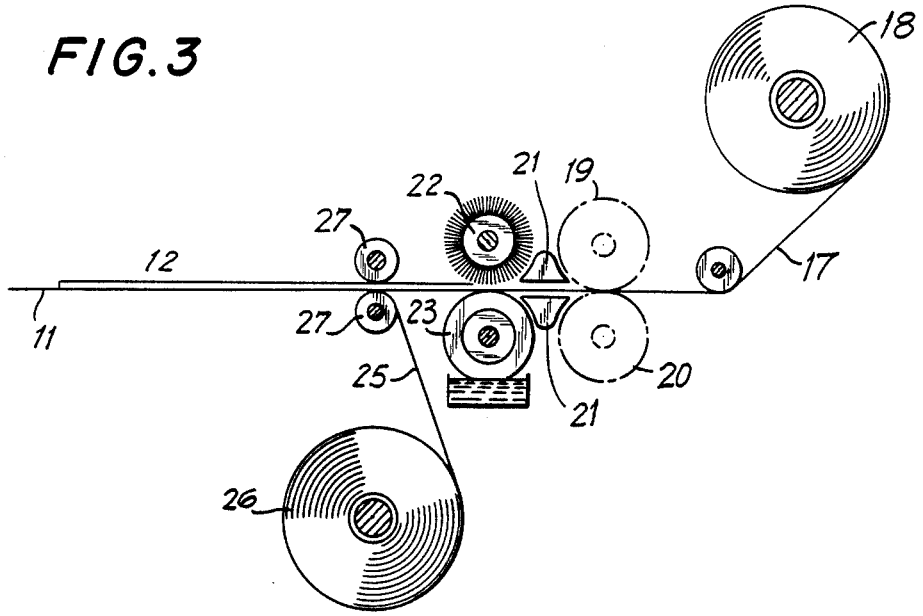
FIG. 3 is a partial schematic view of an apparatus for practicing the method of this invention.

The composite web 10 of this invention generally comprises a layer of paper 11 attached to an expanded web 12. In its use as a cigarette wrapper 13, the composite web is curled about its longitudinal axis to encircle a tobacco rod 14, which may then be attached to a filter 15 by known means. As can be seen, the convolutions 16 in the expanded web 12 run longitudinally down the web and extend in rows across the web width.

In forming the composite web 10, a web of formable material 17 is fed off of a bobbin 18. Web 17 passes between meshing rotary shearing and forming dies 19 and 20. Dies 19 and 20 comprise a plurality of meshing pairs of die elements A–B and C–D extending across the web width, the meshing face of each die element having a width corresponding to the desired width of convolutions 16. As the web 17 passes through dies 19 and 20, each convolution 16 is sheared along its lateral boundaries by teeth on the dies, which also serve to form the web 17 into the convoluted configuration.

After shearing and formation, expanded web 12 (formed from original web 17) passes between guides 21 to accumulator wheel 22. Accumulator wheel 22 is in nip relation to glue wheel 23 which applies a line of glue 24 along the center line of formed web 17. Alternatively, glue wheel 23 may be situated to apply glue line 24 along the center line of web 25 feeding from bobbin 26. As yet another alternative web 12 and web 25 may be simply drawn into a laminated confronting relationship and guided together downstream without the placement of a glue line therebetween.

If glue wheel 23 is located to apply glue line 24 to web 25, a nip roller must be placed in nip relation to accumulator wheel 22 to assist in controlling the feed of web 17 past the accumulator. If desired, the additional roller may be another accumulator wheel.

Web 25 is the paper web which will form the outer layer 11 of the composite wrapper. Web 25 is fed through press rollers 27 to confront the underside of expanded web 12 and so be secured to expanded web 12 along glue line 24. The nip between press rollers 27 should be sufficiently small to urge the confronting webs together for a secure bond, but not so small as to permanently deform the convolutions 16 in expanded web 12. The web bonding is preferably assisted by a heat source to aid in setting the glue line 24. After bonding of the webs together, the composite web 10 may be fed directly into a cigarette making machine for forming into expanded cigarette wrappers.

Web 17 preferably comprises a ductile cellulosic material with sufficient resiliency so that it will not tear at the extremity of each convolution 16 during forming by dies 19 and 20. It also should be sufficiently shearable that it will cut along the lateral boundaries of each convolution during shearing by dies 19 and 20. The material should be strong enough to retain the form imparted to it by the dies. Suitable material may be paper, reconstituted tobacco, flax paper, or mixtures thereof. The material should have a thickness corresponding to the clearance between dies 19 and 20, and that clearance is preferably on the order of 3 mils.

Figure 16:
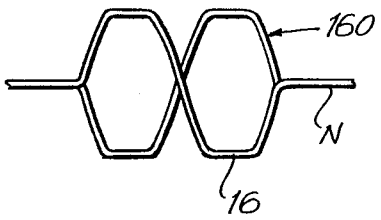
FIGS. 16–18 are schematic views showing a normal, a condensed, and an extended expanded web, respectively.
Figure 17:
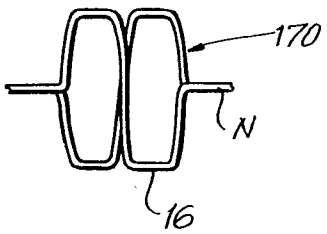
Figure 18:
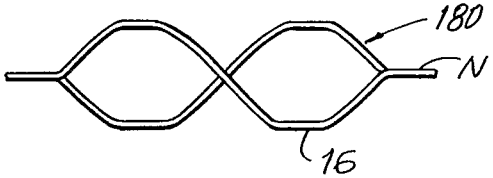

Accumulator wheel 22, in addition to cooperating with glue wheel 23 to form a nip at the point of glue application, also serves to meter the expanded web 12 onto web 25. Accumulator wheel 22, which may be a rotating brush wheel, runs at substantially the same linear speed as the linear speed of web 25, while dies 19 and 20 may run at variable speeds. If the dies run at a linear speed faster than that of web 25 and wheel 22, the periodicity of the generally sinusoidal convolutions 16 imparted to web 17 by dies 19 and 20 will be reduced, resulting in a condensed expanded web 170 (FIG. 17). Conversely, operation of dies 19 and 20 at a linear speed slower than that of wheel 20 and web 25 will increase the periodicity of convolutions 16 and give an extended expanded web 180 (FIG. 18). And operation of the dies at the same linear speed as wheel 22 and web 25 will produce a normal expanded web 160 (FIG. 16).

Figure 4:
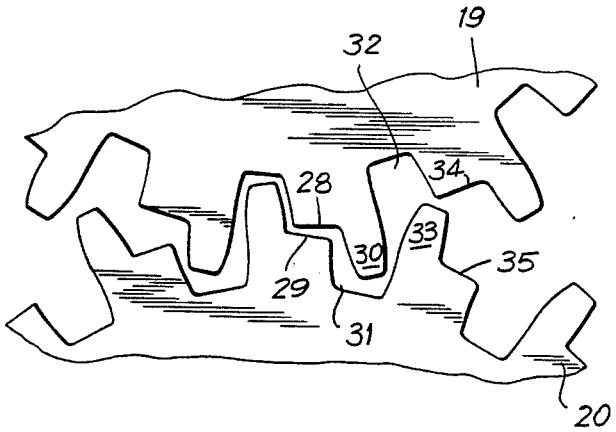
FIG. 4 is a partial plan view of one pair rotary shearing and forming dies suitable for use in the apparatus.
Figure 5:
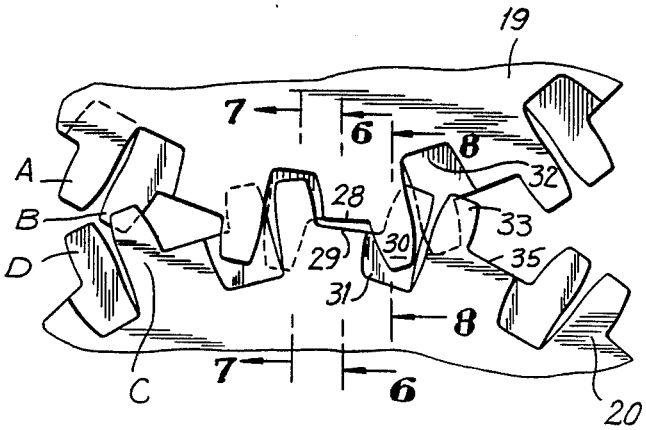
FIG. 5 is a partial plan view of two pairs of rotary shearing and forming dies.

FIG. 4 illustrates the preferred configuration of the meshing teeth of dies 19 and 20. A representative portion of each die includes flat sections 28 and 29, generally sinusoidal tooth 30 and corresponding generally sinusoidal recess 31, and generally sinusoidal tooth 33 and recess 32. When flat sections 28 and 29 are at bottom dead center and top dead center of their respective rotations, they are separated by a clearance substantially equal to the thickness of web 17, and the midway point of that clearance lies in the center of the web thickness. Thus, there is realized a neutral zone N in which there is no deformation of the web by the flat sections of dies 19 and 20.

As dies 19 and 20 further rotate, tooth 30 meshes with recess 31 while maintaining a clearance equal to web thickness. The web 17 is thus formed into the lower half of a generally sinusoidal pattern. Further rotation of dies 19 and 20 meshes tooth 33 with recess 32 to generate the upper half of the sinusoidal convolution and then both dies return to the neutral zone defined by flat sections 34 and 35, where no forming of the web occurs. The length of each die tooth, as defined by the distance, for example, from the bottom of recess 31 to the tip of tooth 33, is on the order of 1 millimeter, although this dimension may be varied as desired to create an expanded web having any required thickness.

In practicing the invention, meshing pairs of die elements A–B and C–D are preferably extended across the width of web 17, each A die element lying 180° out of phase from the next contiguous B die element and each C die element lying 180° out of phase from the next continuous D die element (FIGS. 5–8). The result of this arrangement is that alternate rows of convolutions extend across the web width, each row lying 180° out of phase from its abutting rows. Moreover, each row of convolutions is joined to the next row by a flat segment which lies in the original plane of web 17 and results from lack of formation in the neutral zone N defined by flat die sections 34 and 35 and 28 and 29.

Figure 8:
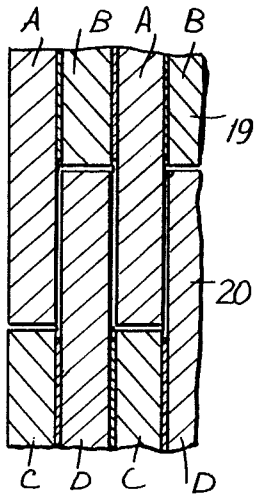
FIGS. 6, 7 and 8 are sectional views taken along lines 6—6, 7—7, and 8—8, respectively, of FIG. 5.
Figure 7:
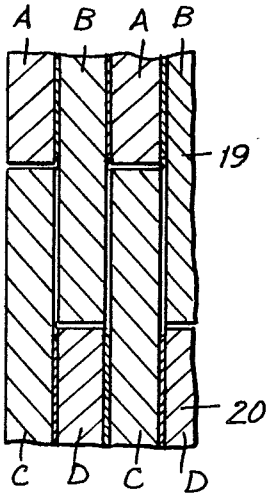
Figure 6:
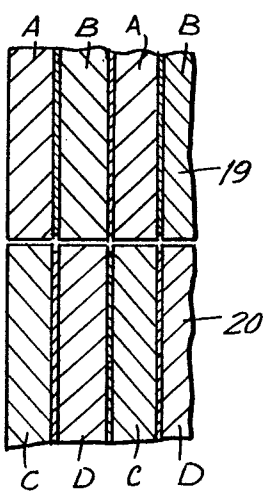

FIGS. 6–8 illustrate the cooperation of dies 19 and 20 during successive points in their rotation. When the flat sections of the dies mesh, they abut web 17 without deformation of the web (FIG. 6). As rotation occurs, tooth 30 forms web 17 while tooth 33 forms the web in the opposite direction to generate the next adjacent convolution 180° a way. Further rotation of the dies reverses their respective effects on the web. Additionally, as dies 19 and 20 rotate, the scissor formed by the lateral edges of successive pairs of teeth 30 and 33 shears the web longitudinally from the end of one neutral zone to the beginning of the next, thus allowing the dies to more readily form the convolutions in web 17.

Web formation also may be assisted by adjusting the moisture content of web 17 prior to formation followed by drying of the formed web 12 to set the sheared and formed configuration. Setting agents also may be applied to the web to help in retaining the formed configuration, and those setting agents may further contain flavorants or additives as desired.

Figure 11:
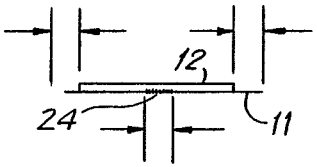
FIGS. 11–13 are schematic views showing the forming and curling of the composite web about its longitudinal axis to form a tube.
Figure 13:
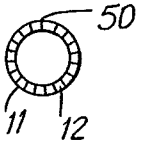
Figure 12:
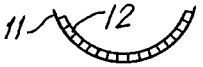

After web 17 is converted by dies 19 and 20 into expanded web 12 and laminated to web 25, it is available for use as a cigarette wrapper. Web 25 provides outer wrapper 11, which is preferably slightly wider than expanded web 12 (FIG. 11). When the composite wrapper 10 is curled about its longitudinal axis to form a tube for encircling a tobacco rod, the additional width of wrapper 11 provides sufficient material for forming a suitable overlapping glue seam by known means. The outer edges of expanded web 12 meet to form butt joint 50 which is covered and held in place by the overlapping glue seam.

Curling of the composite wrapper into a tube causes successive rows of convolutions to overlap slightly at their radially inward ends and to spread slightly at their radially outward ends. Surprisingly, it has been found that, by controlling the periodicity of the convolutions during formation of expanded web 12, the cumulative cross-sectional size of longitudinally-extending gaps 40 can be regulated. By varying the linear speed of dies 19 and 20, the expanded web can be extended or condensed, thus resulting in variation of the size of gaps 40 when the composite web is curled about its longitudinal axis to form a wrapper for a smoking article, such as a cigarette. Proper selection of the size of gaps 40 can result in a total gap area equal to the total perforation area conventionally used in cigarette filter wrap and tipping design and construction. This additional means for controlling gas flow gives the cigarette designer another method of regulating smoke dilution and delivery. Additionally the web may be perforated or may be made of a material with any desired porosity to further enhance its dilution characteristics. Should it be desired to close off gaps 40, an annular plug or other blocking means may be placed at the junction of tobacco rod 14 and filter 15 to preclude gas flow from gaps 40 into the filter.

Figure 15:
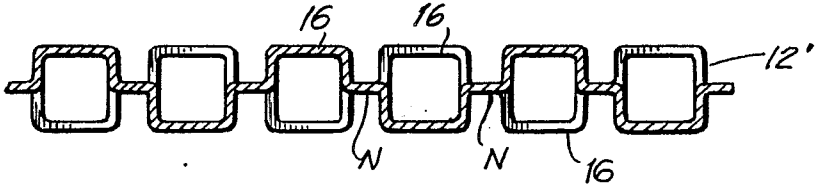
FIG. 15 is a side sectional view of an alternate embodiment of the sheared and formed web.
Figure 9:
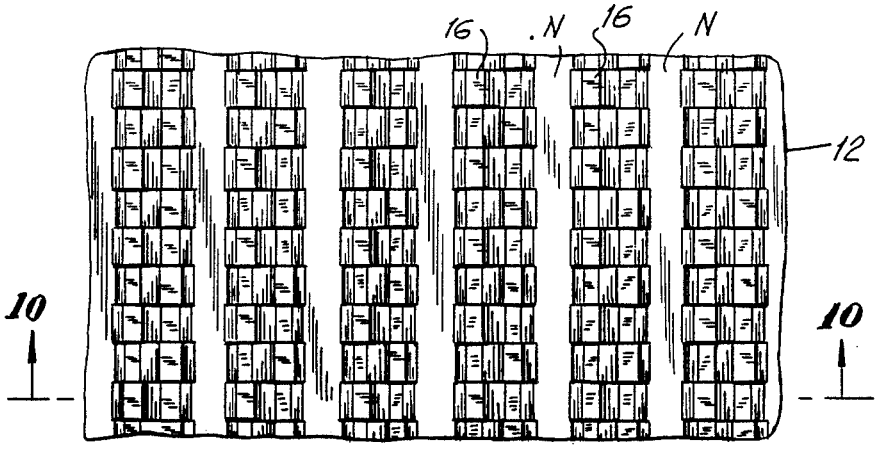
FIG. 9 is a plan view of the sheared and formed web.
Figure 10:
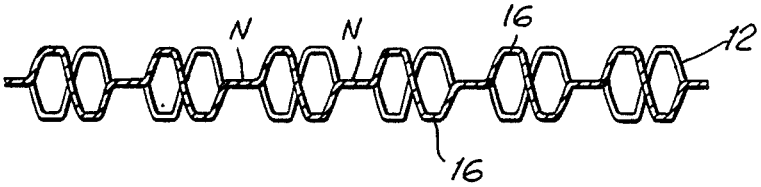
FIG. 10 is a sectional view of the sheared and formed web taken along lines 10—10 of FIG. 9.
Figure 14:
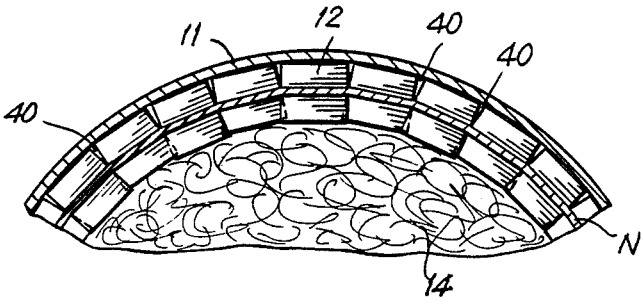
FIG. 14 is a partial sectional view of a cigarette having a wrapper formed from the composite web of this invention.

FIG. 15 illustrates an alternate form 12' of the expanded web achieved by modifying the shape of the teeth on dies 19 and 20. Any die configuration which creates a generally sinusoidal cross section convolution in web 12' may be used within the scope of the invention.

I claim:

1. A method of making an expanded composite web, comprising:

a. providing a first web of formable sheet material;

b. shearing and forming the first web in a plurality of rows across its width to form convolutions extending longitudinally along the web, each convolution extending above and below the original plane of the web in a generally sinusoidal configuration and joined to the next convolution by a web portion lying substantially in the original plane of the web; and c. laminating a surface of the sheared and formed first web to a surface of a second web of sheet material.

2. The method of claim 1 in which the periodicity of the generally sinusoidal convolutions is adjustable.

3. The method of claim 1 or claim 2 in which the web of formable sheet material comprises a sheet material about 3 mils thick.

4. The method of claim 3 in which the web of formable sheet material comprises a cellulosic material.

5. The method of claim 1 in which the second web is cigarette paper.

6. The method of claim 1 or claim 2 in which the width of the web of formable sheet material is substantially an even multiple of a desired cigarette wrapper circumference.

7. The method of claim 1 in which the width of the second web is sufficiently greater than that of the first web to provide an overlap seam upon curling the composite web about its longitudinal axis to form a tube.

8. The method of claim 1 or claim 2 in which each row of convolutions extending longitudinally along the web lies 180° out of phase from its abutting rows.

9. A method of making an expanded web, comprising providing a web of formable sheet material and imparting to the web a configuration of rows of generally sinusoidal convolutions extending longitudinally along the web, each convolution extending above and below the original plane of the web and joined to the next longitudinally succeeding convolution by flat portion of the web lying substantially in the original plane of the web.

10. The method of claim 1 or claim 2 in which the upper and lower extremities of the generally sinusoidal convolutions are generally flat and lie substantially parallel to the original plane of the web of formable sheet material.

11. A composite web, comprising a lamination of first and second webs of sheet material, the first web further comprising expanded sheet material having a plurality of rows of generally sinusoidal convolutions sheared and formed longitudinally along the web and the rows extending across the web width, each convolution extending above and below the original plane of the first web and connected to each successive convolution by a portion of the first web lying substantially in the original plane of the first web.

12. The composite web of claim 11 in which the periodicity of the generally sinusoidal convolutions is adjustable to regulate gas flow along the longitudinal axis of the web.

13. The composite web of claim 11 in which the extremities of the convolutions are generally flat and lie substantially parallel to the original plane of the first web.

14. The composite web of claim 11 in which the first web comprises a sheet material about 3 mils thick.

15. The composite web of claim 14 in which the sheet material comprises a cellulosic material.

16. The composite web of claim 11 in which the second web comprises cigarette paper.

17. The composite web of claim 11 in which the width of the first web is an even multiple of a desired cigarette wrapper circumference.

18. The composite web of claim 11 in which the width of the second web is sufficiently greater than the width of the first web to provide an overlap seam upon curling the composite web about its longitudinal axis to form a tube.

19. The composite web of claim 11 in which each row of convolutions lies 180° out of phase from its abutting rows.

* * * * *